US008272526B1

(12) United States Patent
Vovan et al.

(10) Patent No.: US 8,272,526 B1
(45) Date of Patent: Sep. 25, 2012

(54) TAMPER EVIDENT PULL-TAB CONTAINER

(76) Inventors: Jane N. Vovan, Upland, CA (US); Leon D. Rosen, Santa Monica, CA (US)

( * ) Notice: Subject to any disclaimer, the term of this patent is extended or adjusted under 35 U.S.C. 154(b) by 0 days.

(21) Appl. No.: 13/065,436

(22) Filed: Mar. 22, 2011

(51) Int. Cl.
*B65D 17/34* (2006.01)

(52) U.S. Cl. ..... 220/270; 215/253; 220/260; 220/784; 220/791; 220/793

(58) Field of Classification Search ..... 215/255, 215/301, 305; 220/212, 214, 254.3, 270, 220/713, 789, 791, 793, 254.5, 203.1, 254.1, 220/264; 49/460; 206/807
See application file for complete search history.

(56) References Cited

U.S. PATENT DOCUMENTS

| | | | | | |
|---|---|---|---|---|---|
| 3,656,648 | A * | 4/1972 | Powaloski et al. | 215/253 |
| 3,690,499 | A * | 9/1972 | Westfall et al. | 215/253 |
| 3,866,782 | A * | 2/1975 | Westfall | 215/253 |
| 4,407,423 | A * | 10/1983 | Walter | 220/260 |
| 4,431,110 | A * | 2/1984 | Roth | 215/213 |
| 4,440,310 | A * | 4/1984 | Heyn | 220/270 |
| 4,462,504 | A * | 7/1984 | Roth et al. | 220/214 |
| 4,496,069 | A * | 1/1985 | Winkless et al. | 220/260 |
| 4,519,517 | A * | 5/1985 | Walter | 215/253 |
| 4,711,372 | A * | 12/1987 | Gach | 222/23 |
| 4,742,935 | A * | 5/1988 | Schellenberg | 220/791 |
| 4,778,072 | A * | 10/1988 | Newman | 215/253 |
| 4,966,301 | A * | 10/1990 | Yamashita et al. | 220/270 |
| 5,322,176 | A * | 6/1994 | Dubach | 215/235 |
| 5,511,680 | A * | 4/1996 | Kinne | 206/276 |
| 5,806,710 | A * | 9/1998 | Shiffer et al. | 220/785 |
| 5,931,332 | A * | 8/1999 | Mygatt et al. | 220/270 |
| 6,688,486 | B2 * | 2/2004 | Diamond et al. | 220/785 |
| 6,877,631 | B1 | 4/2005 | Thompson et al. | |
| 6,883,678 | B2 * | 4/2005 | Chou | 220/793 |
| 7,159,733 | B2 | 1/2007 | Pickles | |
| 7,631,776 | B2 | 12/2009 | Vovan et al. | |
| 7,694,837 | B2 | 4/2010 | Robertson et al. | |
| 7,857,154 | B2 | 12/2010 | Pedlar | |
| 7,870,979 | B2 * | 1/2011 | Maki et al. | 222/570 |
| 2006/0249474 | A1 * | 11/2006 | Sawyer et al. | 215/256 |
| 2007/0075030 | A1 * | 4/2007 | Delli Venneri | 215/235 |
| 2008/0128443 | A1 * | 6/2008 | Coughlin et al. | 220/791 |
| 2008/0290091 | A1 * | 11/2008 | Shiffer et al. | 220/270 |
| 2009/0321463 | A1 * | 12/2009 | Vovan | 220/791 |

* cited by examiner

*Primary Examiner* — Anthony Stashick
*Assistant Examiner* — Chetan Chandra

(57) ABSTRACT

A container has a lid (20) that can be opened only by lifting and pulling a pull tab (30), with lifting of the pull-tab resulting in an evident change. The pull tab (30) is held down by attachment (interference fit, weld, glue) to a lid surface (38) by a hold-down (40) that is joined to the pull tab by a pair of bridges (52, 54). When the pull tab is lifted, the bridges are broken. Thereafter, the pull-tab springs up slightly from the lid plane, under the force of one or more spring walls (80, 81) and a hinge (34), which makes it evident that the container has been opened.

20 Claims, 15 Drawing Sheets

TAMPER EVIDENT PULL-TAB CONTAINER

BACKGROUND OF THE INVENTION

Consumer products and especially food, such as salads or grapes, is often sold in plastic containers, wherein a clerk at a store (who observes cleanliness standards) loads fresh food into a container and then closes it. Some customers are concerned that a person might have secretly opened the container to see if he/she likes the food, and then closed the container, leaving germs behind. Customers are assured of the integrity of the packaged food by constructing the container so if the container has been opened after the clerk loaded food into it, this fact will be evident. A container that was easy to open and reclose, and that indicated if it had been opened after the first time that it had been closed, and which could be constructed at low cost to produce a sturdy container, would be of value.

SUMMARY OF THE INVENTION

In accordance with one embodiment of the invention, a low cost tamper evident container is provided which clearly indicates when it has been opened after the first time it was closed as by a store clerk. The container includes a base with a lower cavity portion that forms a cavity to hold food and with a rim portion at the top of the base. The container also includes a lid that closes the base rim, with the edge of the lid hidden by the base rim portion so the lid can be removed only by pulling a pull-tab. The lid and/or the base are of deformable plastic and the other part can be of rigid material.

The lid includes a molded in pull-tab that can be forcefully lifted and then pulled to remove the lid from the base rim. The pull-tab is initially tightly held down facewise to a lid surface by a holddown. A pair of bridges of the holddown connect the pull-tab to the holddown. A person sticks a finger into a recess and lifts the pull tab, thereby breaking the bridges. This allows the pull-tab to be pivoted out about a hinge and then pulled to open the container. When the pull tab is folded down to stow the container, the pull-tab is not held down tightly to the lid surface by the now-broken bridges, and this fact is evident. Instead, the pull-tab springs up to a position above its initial position by inclined spring walls and by the hinge.

The novel features of the invention are set forth with particularity in the appended claims. The invention will be best understood from the following description when read in conjunction with the accompanying drawings.

DETAILED DESCRIPTION OF THE INVENTION

Figure 1:
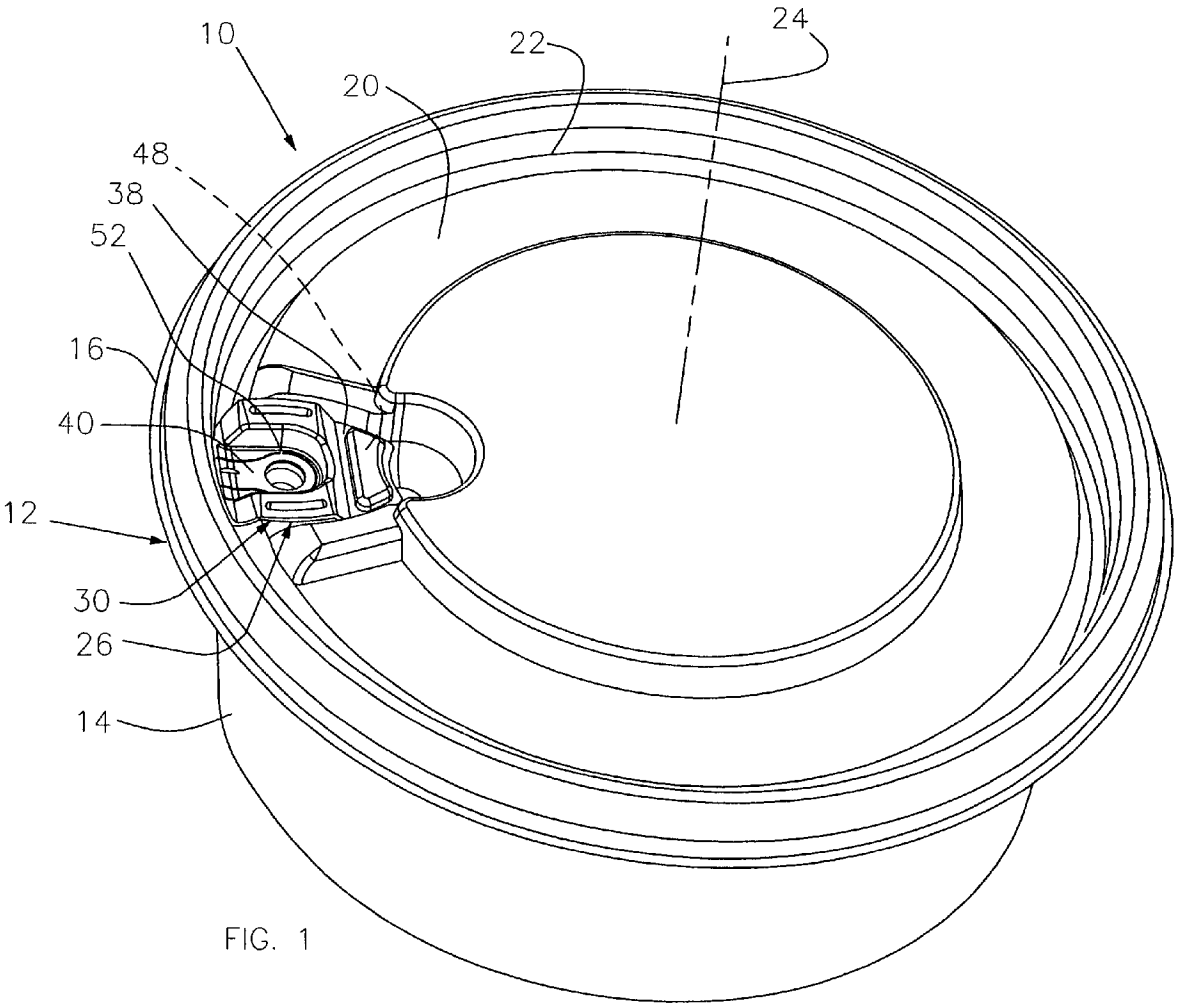
FIG. 1 is a top isometric view of a container of the invention, shown closed and with the pull-tab in an initial stowed configuration, prior to a first opening by a customer.

FIG. 1 shows a container 10 of the invention which includes a base 12 that has a lower portion 14 that holds food or other articles or material, and that has an upper rim 16. The container also includes a lid 20 with a main lid portion 41 which closes an opening 17 (FIG. 2) at the top of the base. The lid and/or the base is formed of an easily deformable molded plastic, so the lid can be pulled forcefully out of the base, despite a lid flange 22 whose perimeter is concealed by the base. The base and lid lie on a vertical axis 24.

Figure 2:
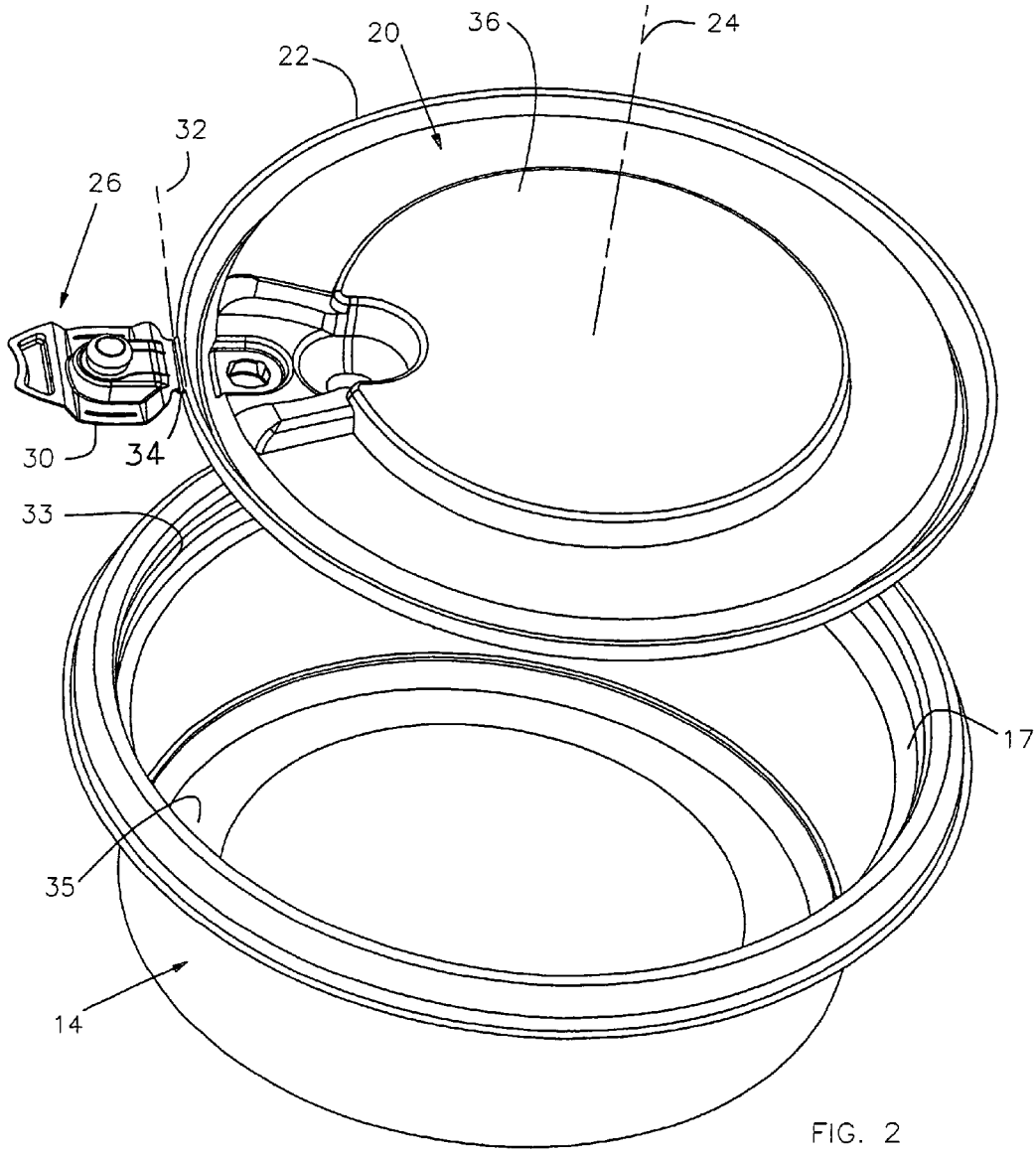
FIG. 2 is a view similar to that of FIG. 1, with the pull tab in an initial deployed position, as initially manufactured, and ready to be closed the first time, on the main lid part.

The lid includes a pull tab assembly 26 that includes a holddown 40 (FIG. 3) and a pull tab 30. FIG. 2 shows the container as it is manufactured. The manufacturer ships the container with the pull tab assembly 26 in the initial deployed position of FIG. 2 wherein the pull-tab 30 has been pivoted by an angle J (FIG. 5) of more than 12° away from the initial stowed position of FIG. 1. In FIG. 2 the pull-tab (as manufactured) is angled 180° from the initial stowed position of FIG. 1, so in FIG. 2 the pull-tab 30 extends radially outward (away from axis 24) from its hinge axis 32. It can be seen that the lid covers the base opening 17 and the pull tab assembly is used only to lift the lid. At a store or food distributor, a clerk loads the base with food and then moves the pull tab 30 to the initial stowed position of FIG. 1 wherein the pull-tab 30 extends radially inward toward the hinge axis and at an angle J of less than 12° to the horizontal (usually less than 6°). Movement to the stowed position is done by a store clerk, by pivoting the pull tab assembly 26 about a hinge pivot axis 32 (FIG. 2) from the initial deployed position shown in FIG. 2 to an initial stowed position shown in FIG. 1. In FIG. 2 the pull tab assembly 26 projects from a circular periphery of a main lid portion 36. The lid flange 22 is hidden because it lies in a groove 33 of the base, and the lid is removed by pulling up the pull-tab.

Figure 5:
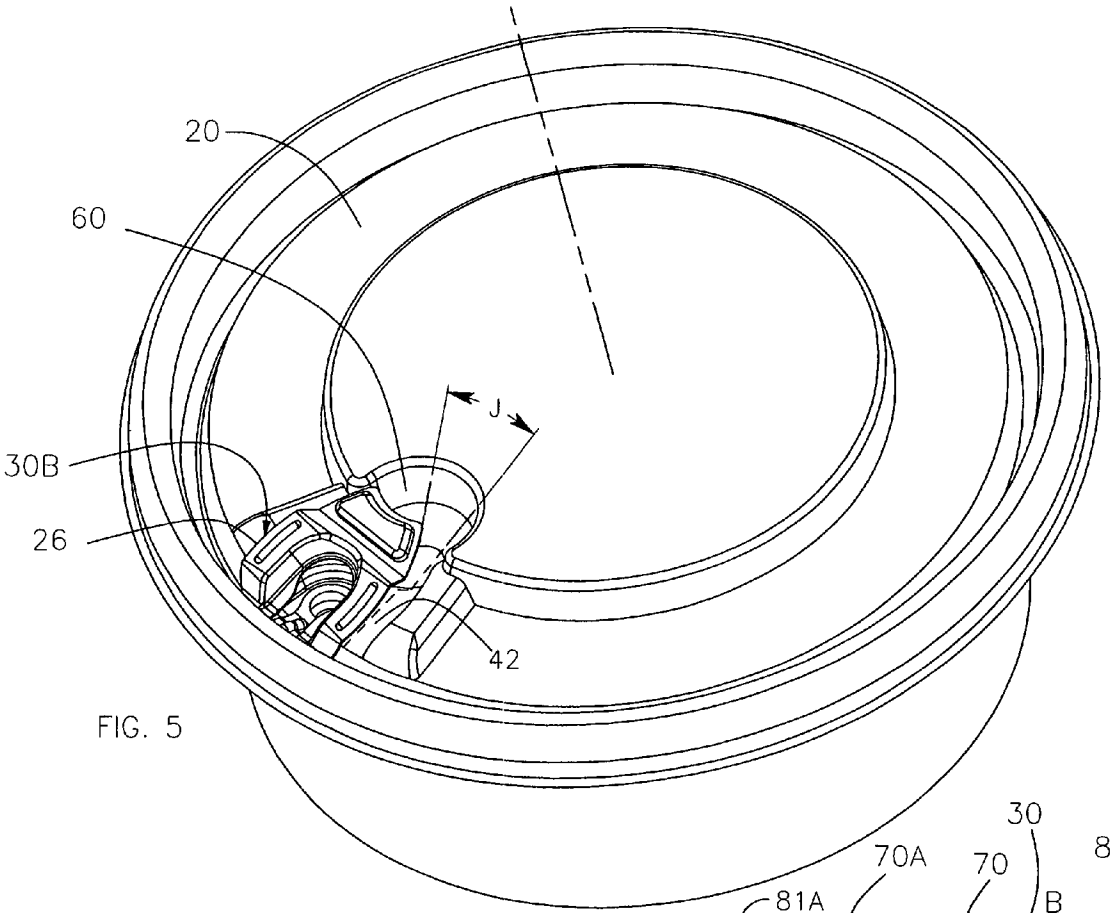
FIG. 5 is an isometric view of the area of FIG. 4, but with the pull tab in its re-stowed and evident-opened position, which it assumes the first time the pull tab is opened by a customer and then closed by the customer, showing how the tab indicates the fact that the container has been opened by a customer.

In the redeployed position of FIG. 5, the pull tab assembly 26 can be pulled up to pull the lid 20 out of the base and thereby provide access to a base cavity 35 (FIG. 2) in the lower base portion 14. Afterwards, the pull tab assembly 26 can be pivoted back toward the stowed position of FIG. 1 but not completely to the stowed position of FIG. 1. Once a customer pulls the pull tab to pivot it more than 12° toward the deployed position of FIG. 2, and then pivots the pull tab toward the stowed position of FIG. 1, it becomes evident that the container has been opened. This provides assurance to customers that if the pull tab assembly appears to never have been opened, it has not been opened (after the store clerk first loaded food into it and closed the lid).

Figure 3:
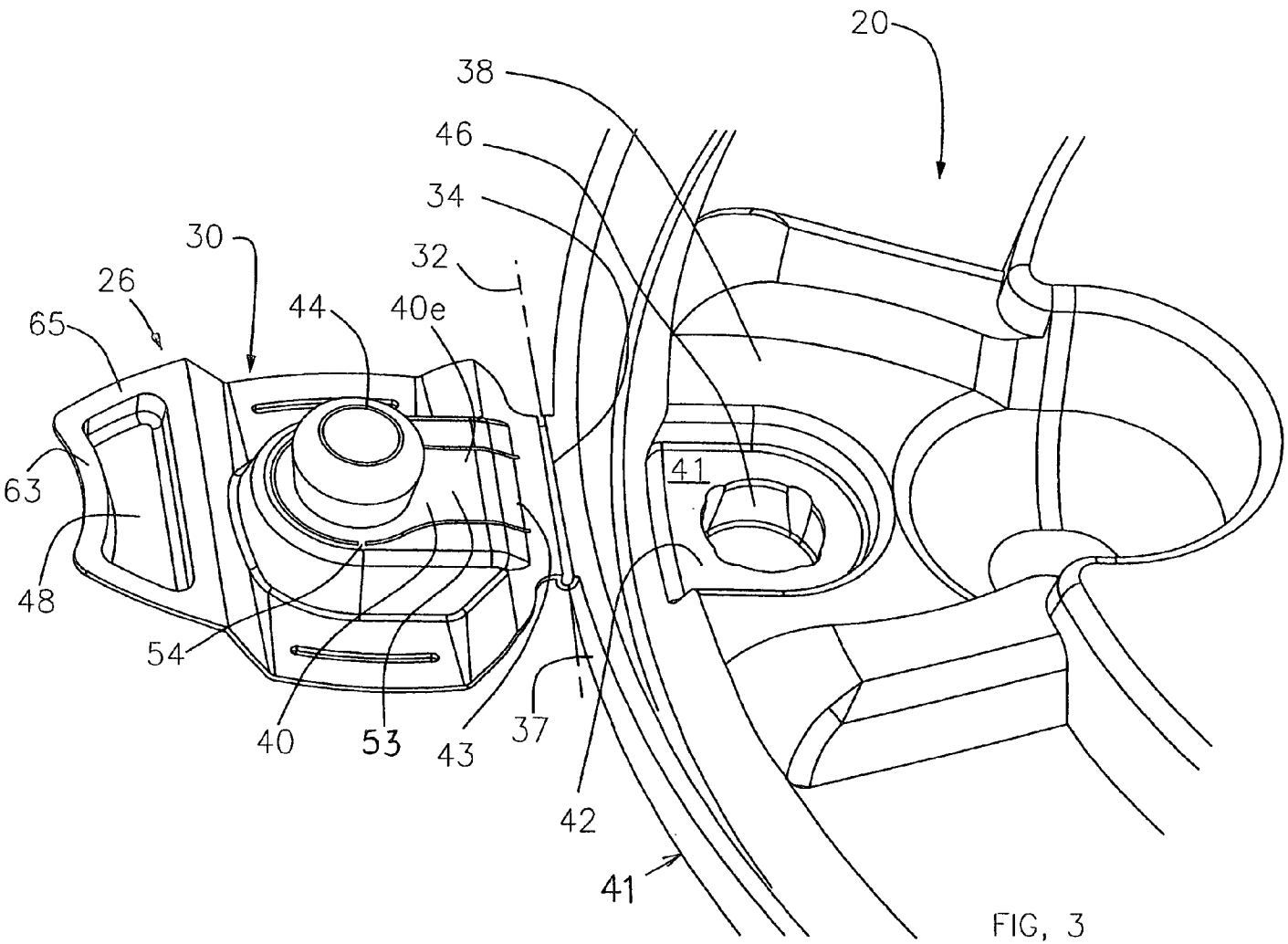
FIG. 3 is a partial isometric view of the lid of FIG. 2, with the pull tab in its initially deployed position and prior to the first time it is closed by a store clerk and then opened by a customer.

FIG. 3 shows details of the pull tab assembly 26, in its configuration as manufactured. The pull tab assembly 26 includes a pull-tab 30 joined by a hinge 34 to an edge portion 37 of the lid main portion to pivot about the hinge axis 32. The pull tab assembly also has a holddown portion or holddown 40 that is connected at to the main lid portion 41. The location 43 lies within 1/29 inch and preferably within ¼ inch of the hinge axis 32. The lid has a tab mount surface 42. The pull-tab lies facewise against the mount surface 42 before a customer lifts the pull-tab, and the pull-tab lies above (at an angle J of at least 12° from the mount surface 42) when the container is reclosed. The pull-tab is connected by a breakable joint in the form of a pair of bridges such as 54 (FIG. 3) to the pull-tab 30. The holddown 40 includes a lock projection 44 that fits into a lock recess 46 in the lid. The lock parts 44, 46 lie in series with the bridges so breaking the bridges allows the pull-tab to be lifted while the lock parts remain locked together. The holddown also includes a thin sheet portion 53 of plastic on which the lock projection 44 is initially formed. When the pull-tab 30 is initially pivoted closed (stowed) on the lid as by a store clerk, to the position shown in FIG. 4, the lock projection 44 fits into the lock recess 46 and locks in position therein. The locking occurs due to an interference fit resulting from the lock recess and projection being undercut. Thereafter, the only way to release the pull-tab 30 is to break a pair of bridges 52, 54 that join the pull-tab 30 to the holddown 40. The pull-tab is partially separated from the holddown by a through slot 85 that is interrupted by the bridges 52, 54 and the connection 43. It would be possible to use a single breakable bridge, such as at the center, although applicant prefers to have a pair of such bridges.

When a customer wants to open the container after food has been loaded in by a store clerk and the lid 20 has been closed, the customer inserts a finger (e.g. the index finger) into a finger recess 60 (FIG. 4) so the person's finger lies under a tip part 62 of the pull tab 30. The person then pries up the tip part to pry up the pull-tab 30 and break the bridges 52, 54. This separates the pull-tab 30 from the holddown 40 (except at the holddown end 40*e* that lies adjacent to the hinge 34). The holddown 40 remains locked through the lock projection 44 and lock recess 46 to the main circular portion 36 of the lid. A customer can pull up the pull-tab 30 to lift the lid off the base. The pull tab is formed with a recess 48 (FIG. 3) that lies adjacent to the tip 63. The recess 48 stiffens the end of the pull tab and makes it easier to tightly hold the pull tab without slipping.

Figure 4:
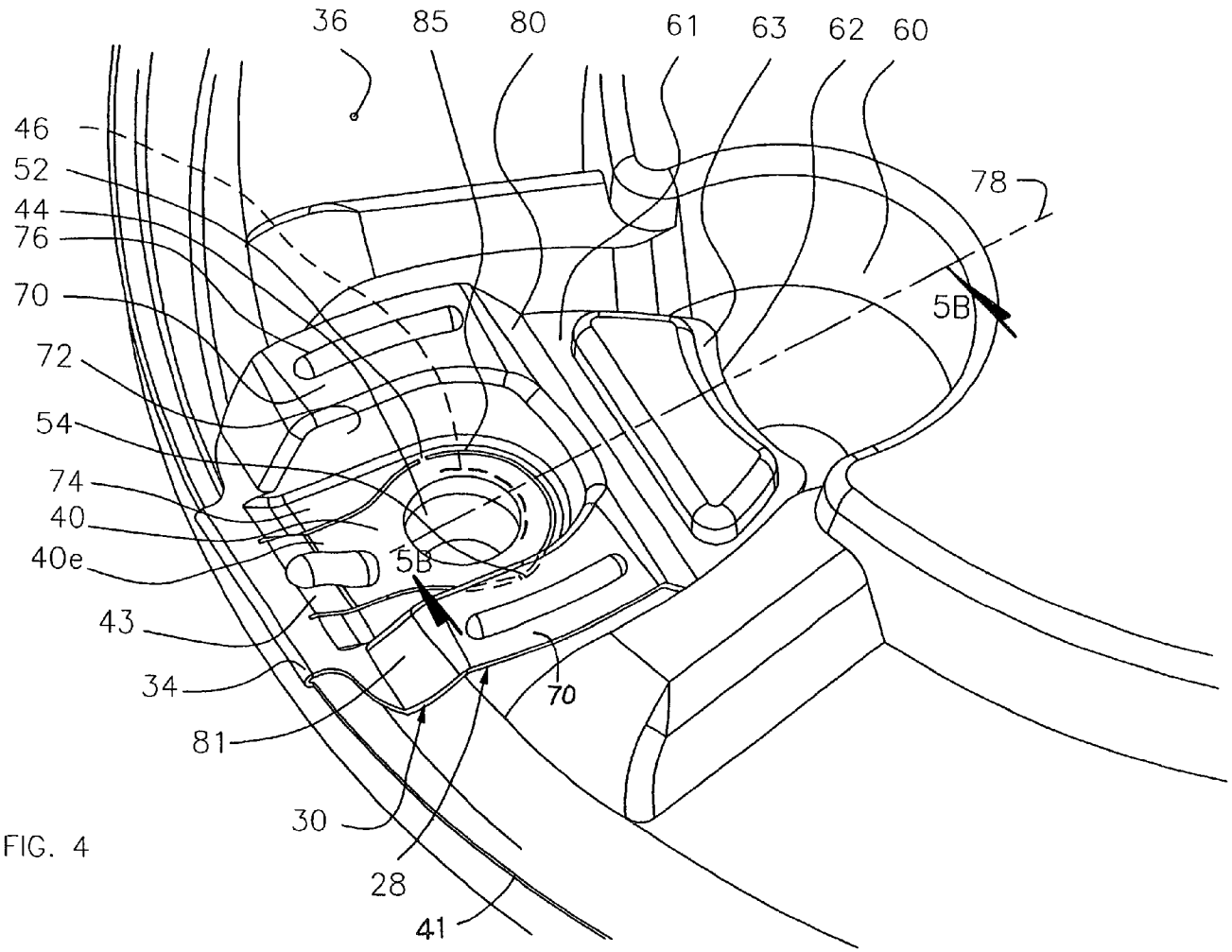
FIG. 4 is a partial isometric view of the area shown in FIG. 3, but with the pull tab in its initial stowed position, which it assumes prior to the first time the pull tab is opened by a customer.

When a customer again closes the container, and pivots the pull tab 30 back toward its original position of FIG. 1, the pull tab surface 65 (FIG. 3) does not lie "flat" against a lid surface 38 (FIG. 3), but springs up slightly as to the position shown at 30B in FIG. 5. Two major phenomena keep the pull-tab in a raised position such as in FIG. 5. These phenomena include the hinge 34 (FIG. 3) and the resilience of spring walls 80, 81 (FIG. 4). The resilience of the spring walls 80, 81 results in the pull-tab moving upward (above the lid main portion 41 in FIG. 4) when the bridges 52, 54 are broken, while the holddown 40 does not move upward, so the pull tab 30 lies above the holddown.

The hinge 34 (FIG. 3) by which the pull tab 30 is connected to the lid does not tend to remain in the 180° folded position of FIG. 1, but tends to straighten by a plurality of degrees, preferably at least 6° and more preferably at least 12° from the 0° angled position of FIG. 4. As a result, the pull tab pivots up and is angled J by a plurality of degrees from a flat position, as shown in FIG. 5. After the bridges 52, 54 are broken, the holddown 40 is connected to the pull tab 30 only though through the holddown end 43 (FIG. 3), which is close to the hinge axis 32 and therefore has little effect upon the position of the pull-tab. The resilience of the hinge therefore urges the pull-tab to pivot upward.

A plurality of spring walls, including walls 80, 81 (FIG. 4) raise the pull tab toward the raised position of FIG. 5. Applicant constructs the pull tab 30 (FIG. 4) with a raised periphery 70 (FIG. 4). The raised periphery 70 is supported on largely vertical inclined walls 72 extending at upward inclines from the pull tab bridge surface 74 (that connects to the bridges 52, 54) to the raised periphery 70. This stiffens the pull tab 30 against bending. The raised periphery 70 also has a pair of stiffening ridges 76 to resist bending. Thus, when the pull tab 30 is broken free of the holddown 40, except at the hinge 34, the pull tab 30 is a stiff member. Applicant notes that the pull tab 30 is symmetric about a radial line 78.

The raised periphery 70 (FIG. 4) connects through a radially-inward (toward axis 24) and downward inclined spring wall 80 to pull-tab surface portions 61, 63. The pull tab assembly is constructed so the spring wall 80 tends to raise the periphery 70 and the tab surface, although the bridge surface is initially held down through the bridges 52, 54 to the holddown 40. However, when the bridges 52, 54 are first broken, which occurs when a customer forcefully lifts the tip part 62, the spring wall 80 lifts the periphery 70 and the bridge surface 74. The tab surface 61 then lies above the holddown 40, and this is very apparent to customers.

Figure 5A:
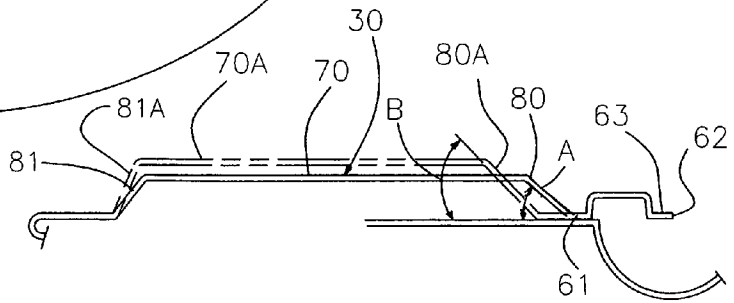
FIG. 5A is a simplified sectional view of the pull-tab region of the container, showing it in two positions.

FIG. 5A shows that when the manufacturer first pivots the pull-tab to the stowed position, the manufacturer pushes down the raised periphery from 70A to 70 so its angle from the horizontal moves from B to A. The pull-tab is held in this position by the holddown 40 (FIG. 4). In this position the spring walls 80, 81 have been deflected toward the horizontal. When the pull-tab is thereafter raised and the bridges 52, 54 to the holddown are broken, the pull-tab will not return to the original factory position. Instead, the periphery 70 will rise to position 70A as the spring walls 80, 81 return toward more vertical positions 80A, 81A. It is possible to provide only one spring wall such as 80, although applicant prefers to use at least two spring walls 80, 81.

Figure 5C:
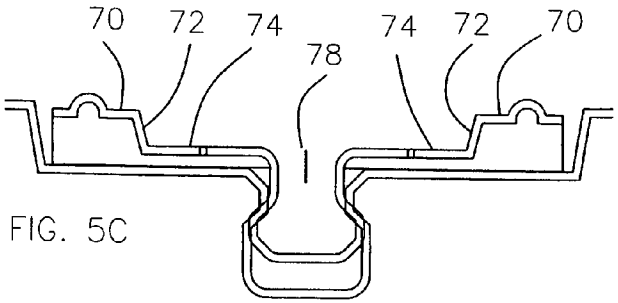
FIG. 5C through FIG. 5E are views taken on line 5D-5D of FIG. 6, showing the pull tab as it is being installed in the holddown, showing the pull-tab as it appears when fully installed in the holddown by a store clerk, and showing the pull-tab as it appears after the bridges have been broken by a customer.
Figure 5D:
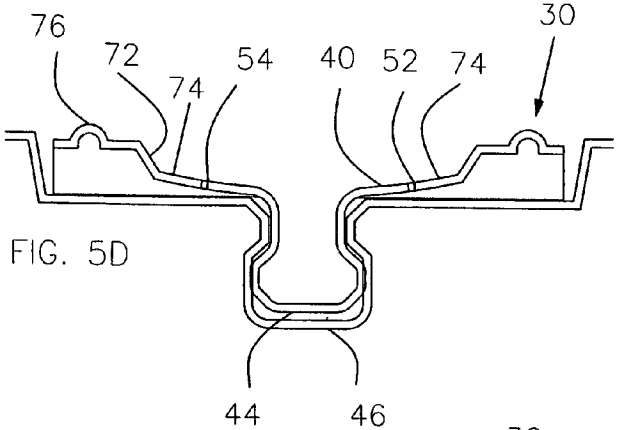
Figure 5E:
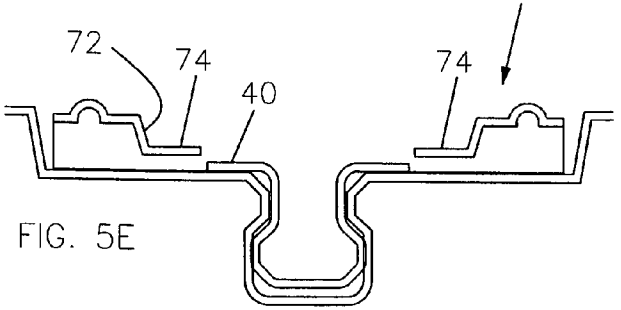
Figure 5B:
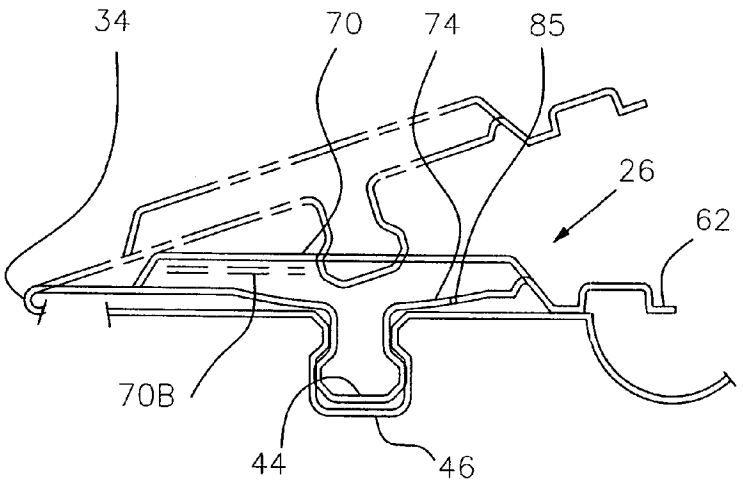
FIG. 5B is a view taken on line 5B-5B of FIG. 4, showing the pull-tab periphery and bridge surface.

FIG. 5B is a view taken along line 5B-5B of FIG. 4, showing the pull tab assembly 26 as a store clerk is depressing it. The pull tab assembly is pressed down until the projection 44 (FIG. 5B) is pressed into the undercut recess 46. During such pressing, the store clerk depresses the raised periphery 70 to position 70B, while also depressing the bridge surface 74. Afterward, the periphery tends to spring up to position 70B.

Figure 6:
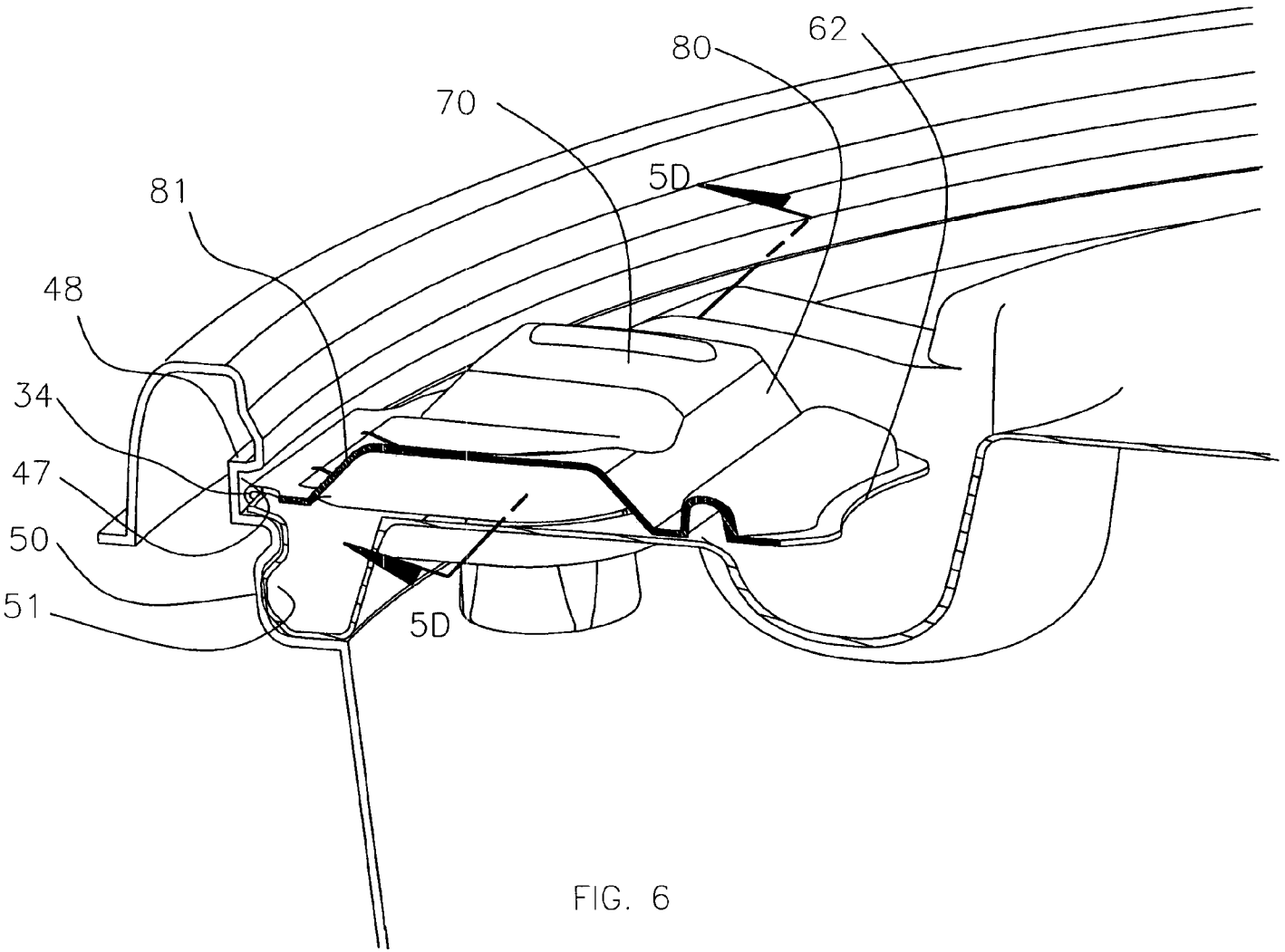
FIG. 6 is a sectional view of a portion of the container of FIG. 4, in its initial stowed position and prior to an opening by a customer.

FIG. 5C is a view taken on line 5D-5D of FIG. 6, showing the raised periphery 70 that lies on circumferentially opposite sides of a radial line 78, which is also shown in FIG. 4. FIG. 5D shows that opposite bridge surfaces 74 and the inclined walls 72 are also depressed and bent by the store clerk during initial installation. As the projection 44 is forced into the recess 46 to initially close, or stow, the pull-tab, the bridge surfaces 74 are downwardly bent to depress the holddown 40. The bent bridge surfaces 74 are maintained in the downward bent configuration until a customer lifts the tip part 62 (FIG. 5B) and breaks the bridges 52, 54. FIG. 5E shows that a person can see a gap between the holddown 40 and the bridge surface 74 of the pull-tab after the bridges have been broken.

The pull-tab is held to the main lid part through a breakable joint which includes the lock projection 44 (FIG. 3) that lies in an interference fit in the lock recess 46 and which is not a breakable part. The pull-tab also includes the bridges 52, 54 that are breakable. Together they form a breakable joint.

Instead of using a lock projection 44 (FIG. 3) and lock recess 46 to initially hold the pull tab in the initial stowed position as supplied by the manufacturer, other holddown means can be used. It is possible to use a bonded joint, formed by a weld or adhesive, to fasten the holddown 40 to the lid main portion at 41 (FIG. 3) and use that as a breakable joint instead of the bridges 52, 54. In any case, it is desirable to lock the pull-tab to lid main portion at 41 with the pull tab pressed downward against the mount surface 42, so the spring walls 80, 81 (FIG. 4) are deflected towards the horizontal and tend to spring back to be more vertical.

FIG. 6 is a view similar to FIG. 5A, and shows a cross-section of the container taken through the raised periphery 70. Applicant notes that the rim of the base and lid form a convexly-curved seal 51 on the lid that abuts a concavely-curved seal 50 formed by the base. The base forms a radially inward-opening recess 47 that receives the hinge 34 that is formed by the lid. The hinge has a smaller height than the hinge-receiving recess to leave a vertical gap between a top of the hinge and a top wall of the recess which is large enough to let the pull-tab pivot upward by more than 6° from an initial stowed position. Walls of the recess 47 form an overhang 48 that deters tampering.

Figure 7:
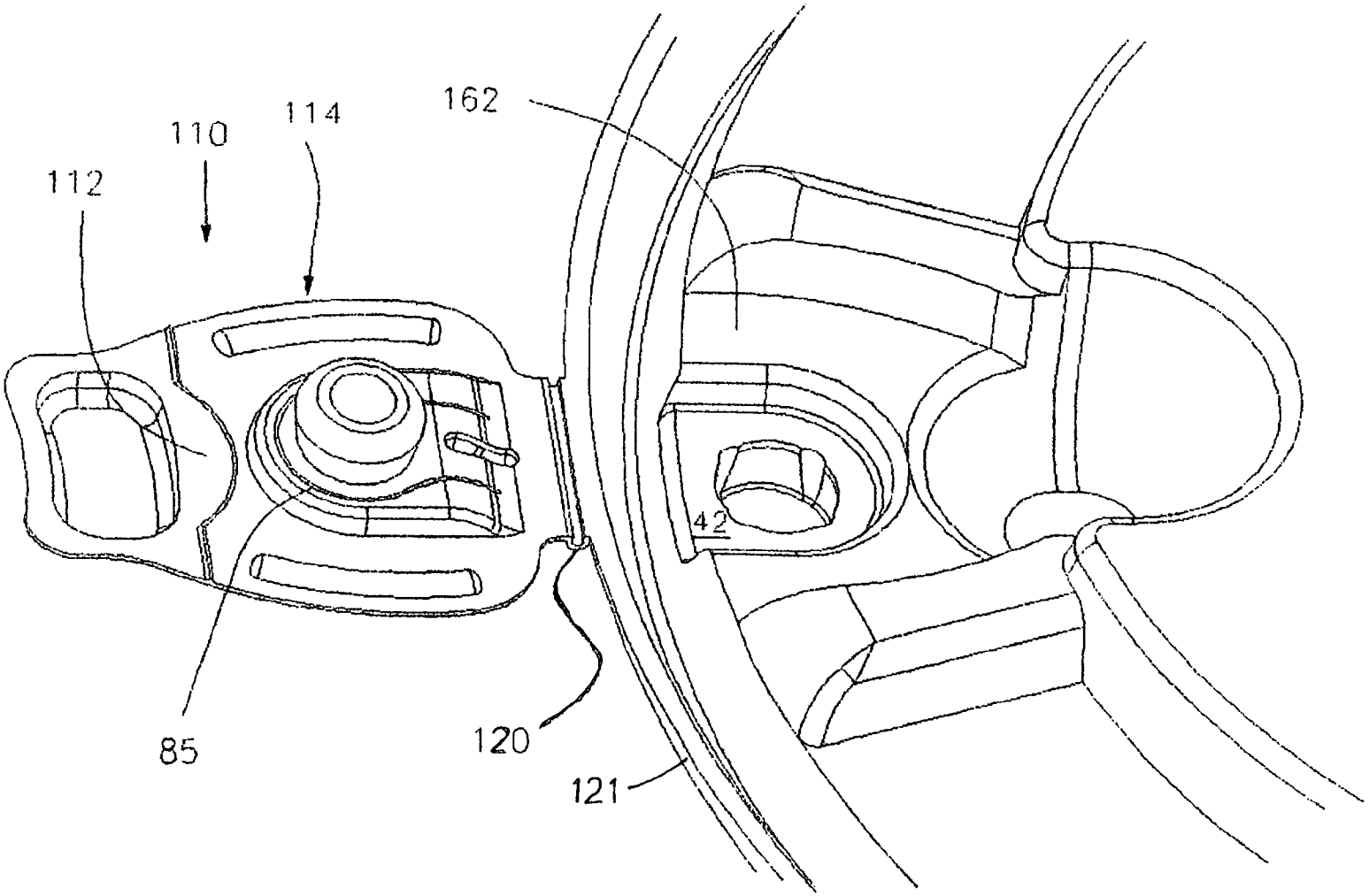
FIG. 7 is a top isometric view of a portion of a container of another embodiment of the invention, as manufactured and in its initial deployed position.
Figure 8:
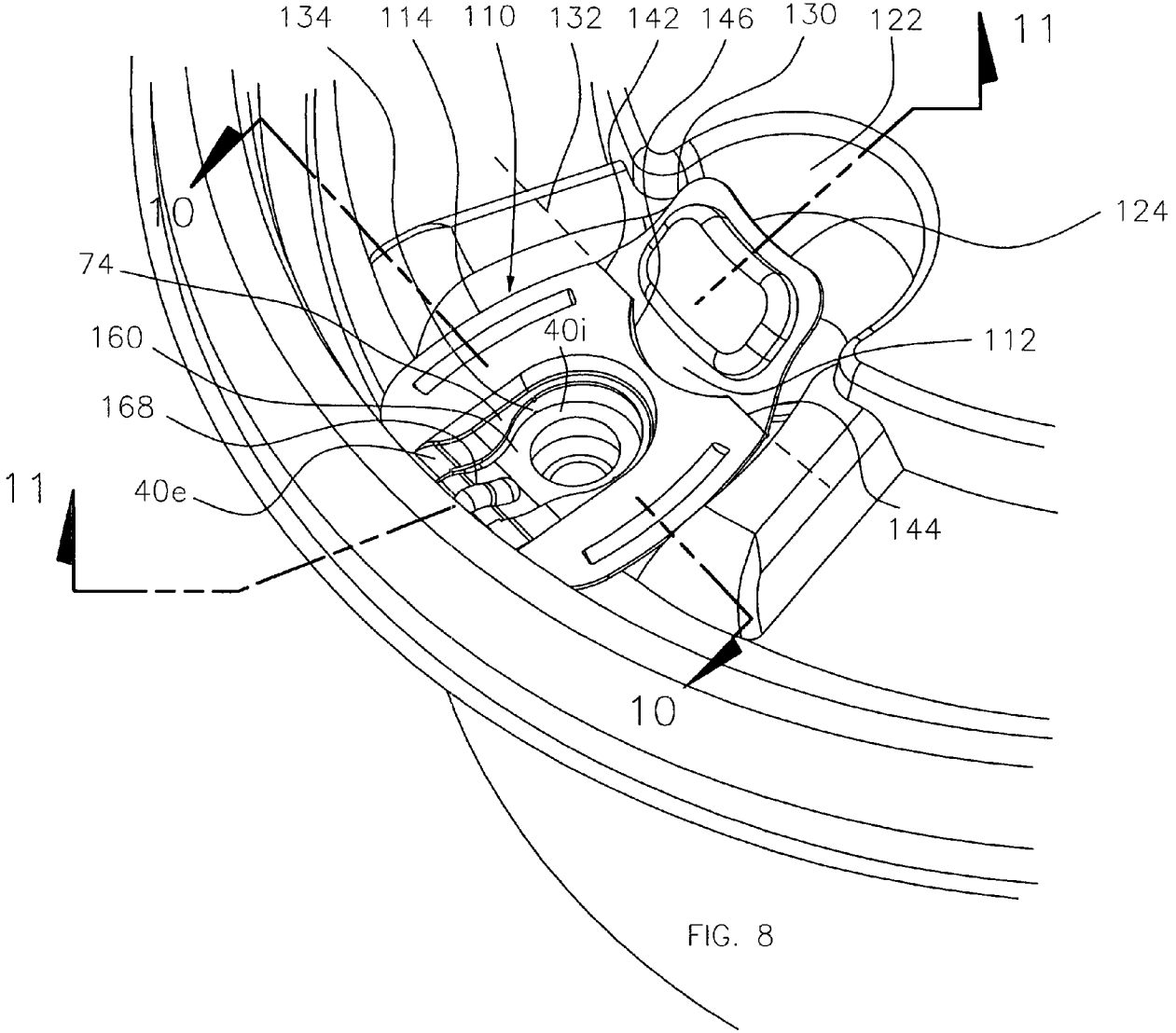
FIG. 8 is a view similar to FIG. 7, but showing the container after the pull-tab has been moved to an initial stowed position and when the tip region has been partially lifted.

FIG. 7 shows another embodiment of the invention, wherein a pull-tab assembly 110 has a spring wall 112 that raises the pull-tab 114 after a first opening. The pull-tab assembly 110 includes a hinge 120 that connects to a pull tab 114. At a factory, the pull tab assembly 110 is pivoted about hinge 120 to a closed, or stowed position wherein the pull tab 114 lies over the lid main portion 121 at an angle of less than 12° (preferably less than 6°) to the lid main portion surface. FIG. 8 shows the pull-tab assembly 110 in the initial stowed position to which a store clerk has positioned the pull-tab, except that a customer has then inserted his finger into the finger hole 122 and lifted the tip 124 of the pull-tab. When the tip 124 has been lifted, a tip region 130 of the pull-tab pivots about a pivot axis 132. The pull tab is scored along the axis 132 to weaken it at locations 142, 144 to pivot thereat, and is cut through along curved line 146 to form a radially outward projection at 112. When the tip inner end region 130 is pivoted up (e.g. over 6°) by a customer to the raised position of FIG. 8, the spring wall projection 112 lifts the pull-tab 110 and breaks a bridge 134. The next time a customer moves the pull tab to the restowed position, the spring wall 112 prevents the pull tab from lying "flat" so the pull tab is raised (preferably by at least 12°).

Figure 9:
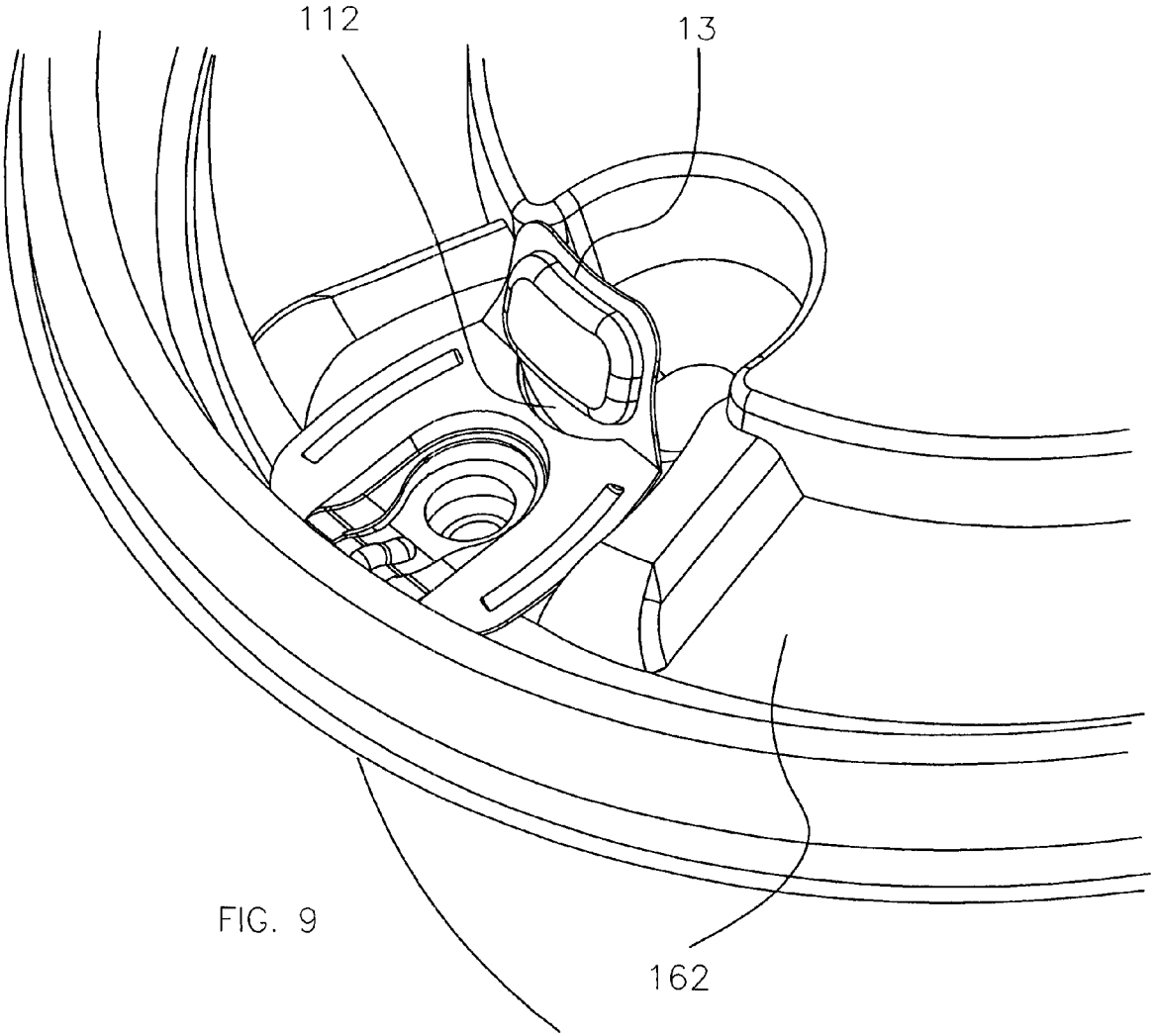
FIG. 9 is a view similar to FIG. 8, after the tip region has been lifted by a customer.
Figure 10:
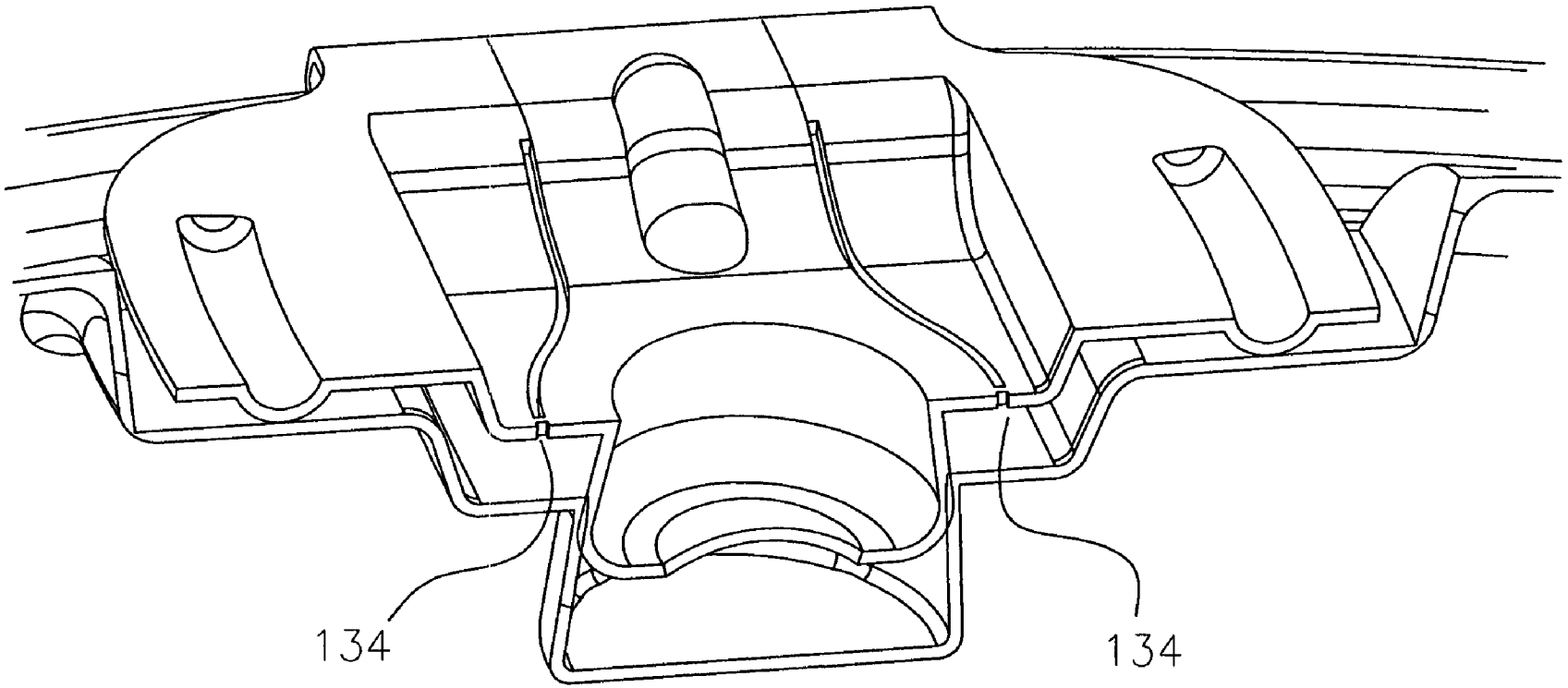
FIG. 10 is an isometric sectional view of the pull-tab of FIG. 8 taken on line 10-10 of FIG. 8, prior to opening the container.
Figure 11:
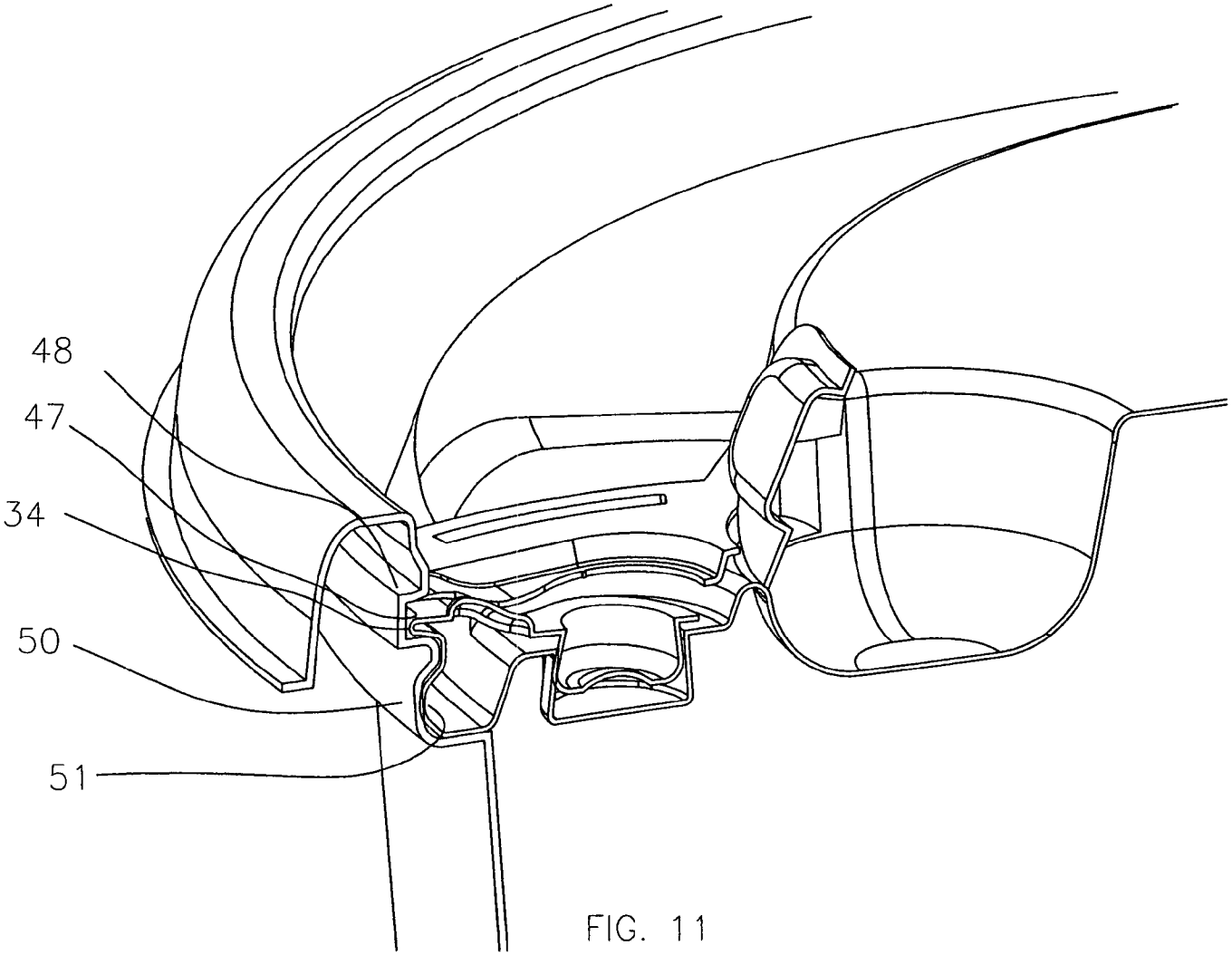
FIG. 11 is an isometric sectional view of the pull-tab of FIG. 8, taken on line 11-11 of FIG. 8, when the tip region has been partially lifted.

The pull-tab inner end, or tip region 130 is connected through bridge 134 to a flat holddown 160. When pull-tab region 130 is lifted, it breaks the bridge 134. After the bridge is broken, the spring wall 112 keeps the pull-tab lifted as shown in FIG. 9, with the spring wall 112 pressing against the lid main portion 162 and with the tip region 13 being raised.

FIG. 8 shows that the holddown 160 has a stiffening rib 168 at the radially outer end portion 40*e* of the holddown. The rib 168 prevents the holddown end portion 40*e* from bending up to place the radially inner end 40*i* of the holddown at the same level as the bridge surface 74 when a customer has not opened the container and restowed the pull-tab.

Figure 12:
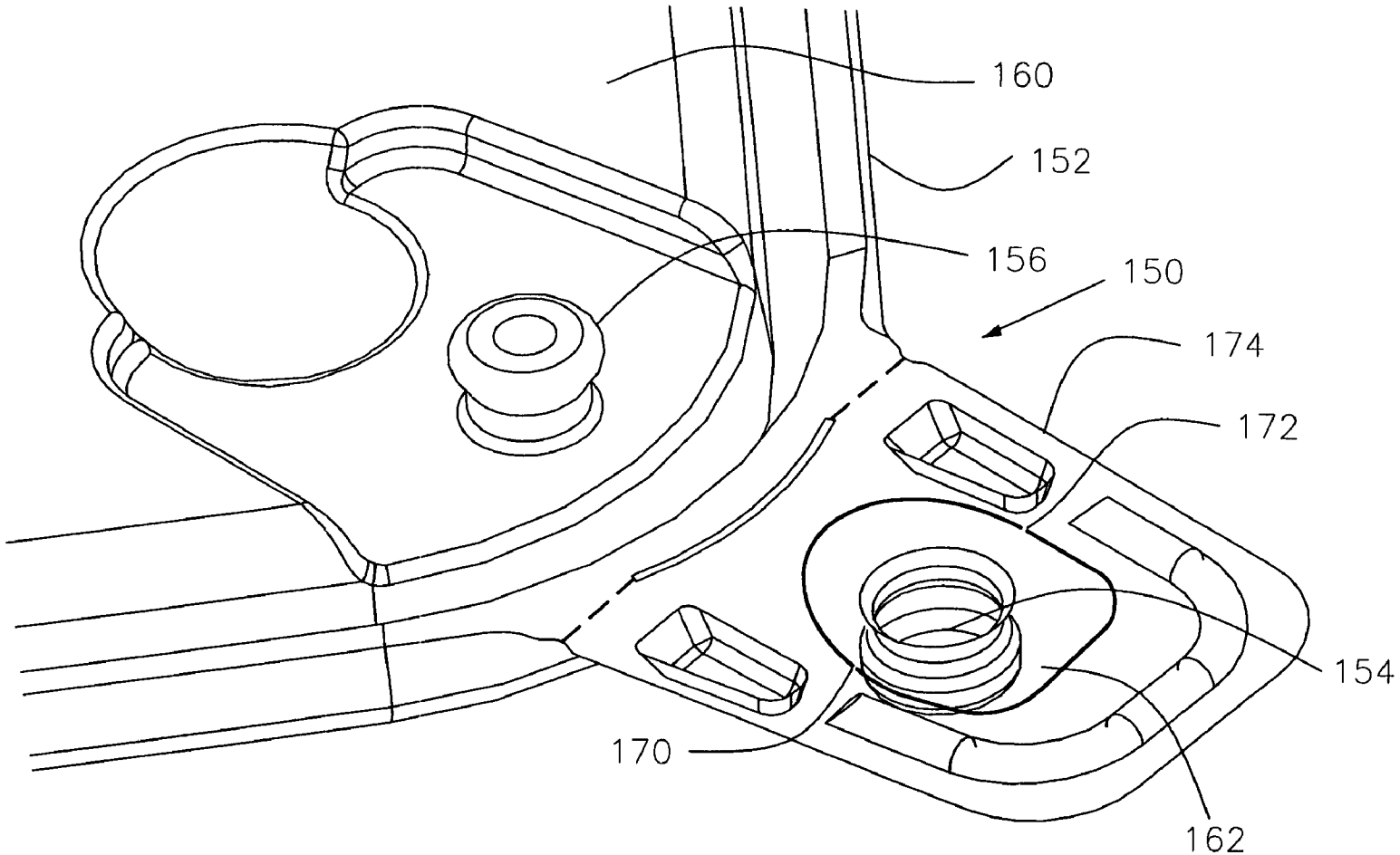
FIG. 12 is a partial isometric view of a portion of a rectangular container with a pull tab assembly in the initial deployed position.
Figure 13:
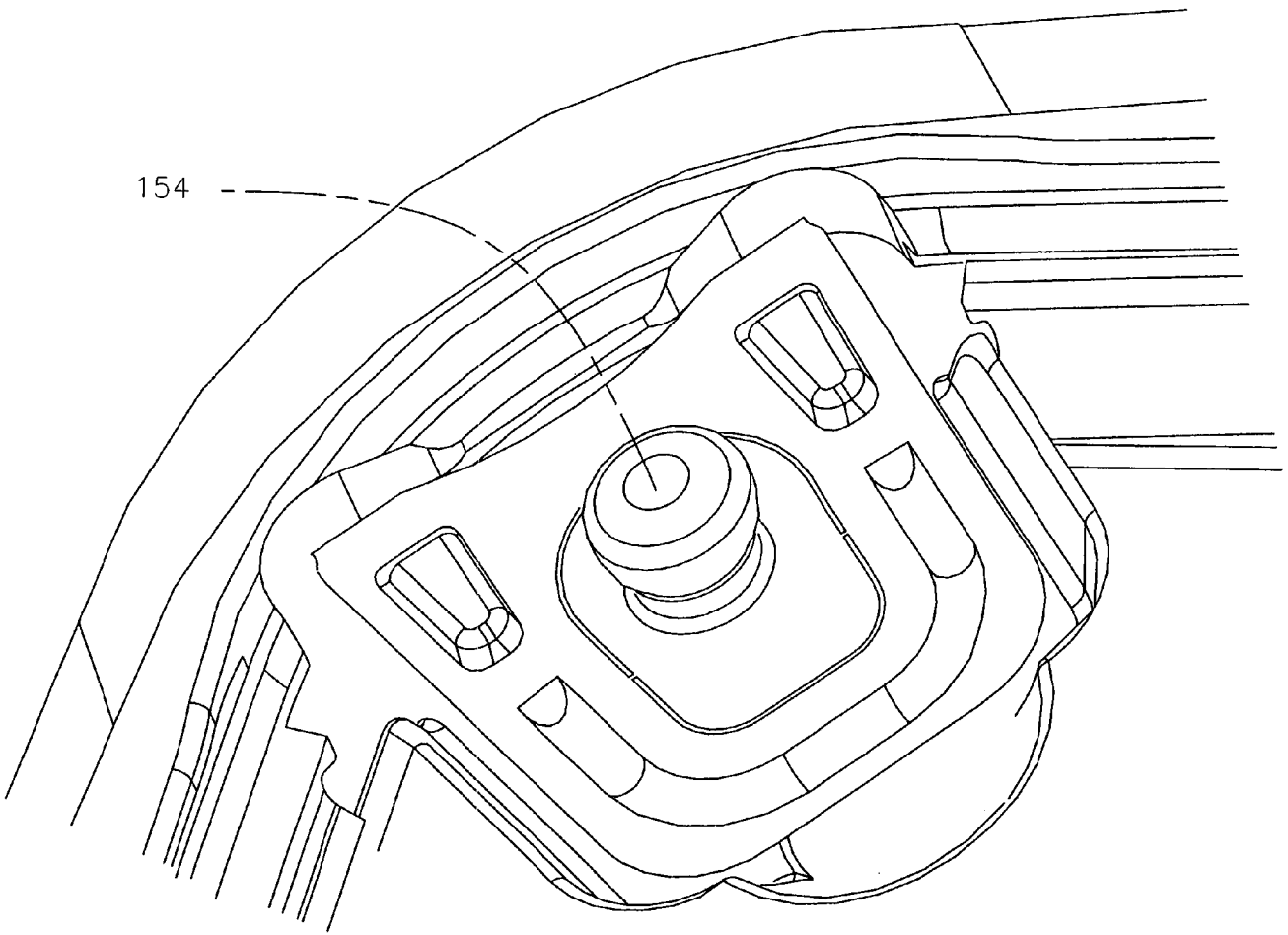
FIG. 13 is an isometric view of the embodiment of FIG. 12 with the pull-tab in the initial stowed position.

FIGS. 12 and 13 show a pull tab assembly 150 of a rectangular container 152 (with a vertical axis, not shown). In this container, the undercut lock recess 154 lies in the pull tab 174 and the projection 156 lies on the main lid portion 160. A holddown 162 on the pull-tab assembly 150 is joined by bridges 170, 172 to the pull tab 174.

Figure 14:
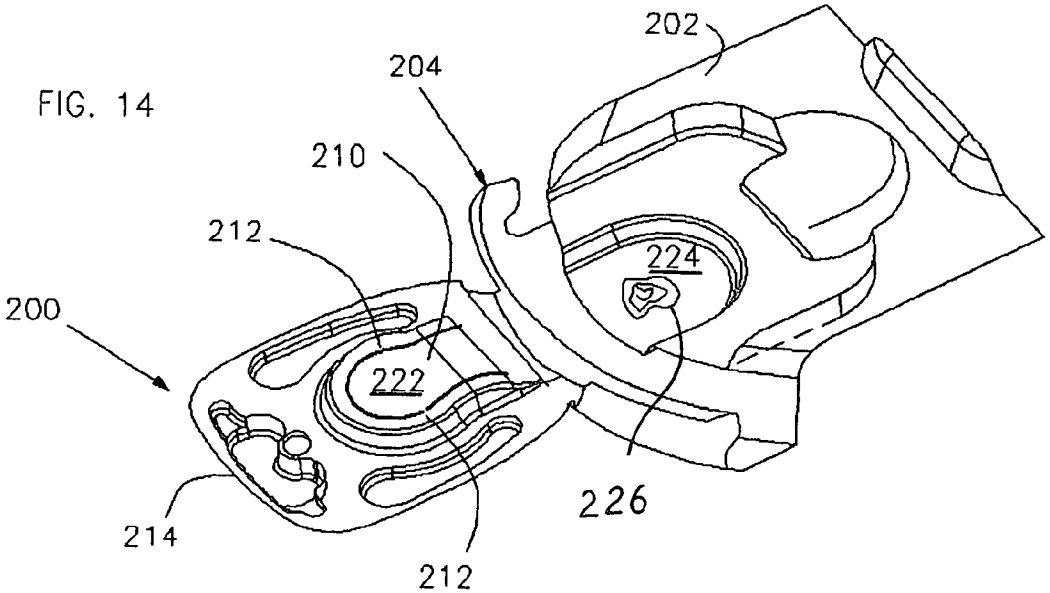
FIG. 14 is a partial isometric view of a container of another embodiment of the invention wherein the pull-tab is designed to be bonded to the main lid portion and the pull tab is in its initial deployed position.
Figure 15:
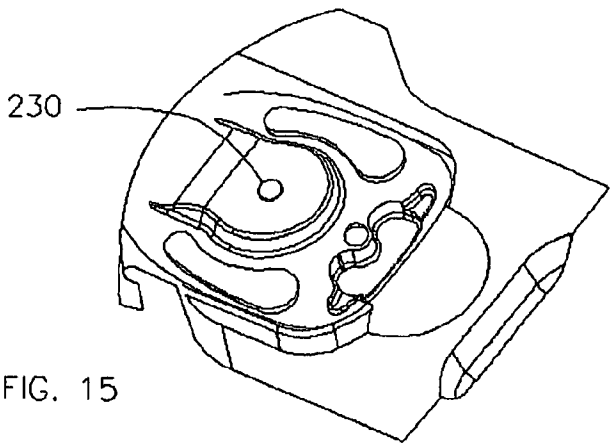
FIG. 15 is a view similar to that of FIG. 14, but with the pull-tab in an initial stowed position.

FIGS. 14 and 15 show another pull tab assembly 200 mounted on a main lid portion 202 of a lid 204. The pull tab assembly includes a holddown 210 joined by bridges 212 to the pull-tab 214. However, the holddown 210 is not joined by a projection and recess to the main lid portion 202, but is joined by a bonded connection. In FIG. 14 the bonded connection is a joining of the regions 222, 224 by adhesive 226. FIG. 15 shows a bonded connection made by welding at spot 230. Welding usually comprises sonic welding although heat welding can be used.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A container that has a vertical axis and that includes a base that can hold goods and a lid with a main lid part that covers the base and with a pull-tab assembly that includes a pull-tab that is pivotally connected about a hinge axis to the main lid part to allow the pull-tab to pivot between a stowed position wherein the pull-tab lies closely over the main lid part and a deployed position wherein the pull tab extends at an angle of a plurality of degrees from said stowed position, wherein:

in said stowed position said pull-tab is fixed by a breakable joint to said main lid part;

said pull-tab has a spring wall that is resiliently deformed when said pull tab is forced downward to said stowed position and fixed by said breakable joint to said main lid part, so when said breakable joint is broken the pull-tab springs up to a raised position;

said pull-tab assembly includes a holddown that is attachable to said main lid part;

said spring wall includes a pair of raised portions on opposite sides of said breakable joint, and a pair of bridge surfaces extending from said pair of raised portions to said one breakable joint, said pair of bridge surfaces being bent to extend at a downward incline when said pull-tab is forced downward to said stowed position.

2. The container of claim 1 wherein said pull-tab includes a stiffening ridge to resist bending.

3. The container of claim 1 wherein said lid includes a finger recess to provide access for a finger under a tip part to pull the pull-tab.

4. The container of claim 1 wherein said pull-tab includes a recess that lies adjacent to a pull-tab tip, said recess stiffening the end of the pull-tab.

5. The container of claim 1 wherein said pull tab includes a lock projection and said main lid part includes a lock recess;

said lock projection and said lock recess being engagable with an interference fit.

6. The container of claim 1 wherein said pull tab and said holddown are partially separated by a through slot.

7. The container of claim 1 wherein said lid is engageable with the base and said pull tab assembly is disposed on said lid, wherein:

said holddown is attachable to said main lid part of said lid; and said pull tab is pivotally attached to said lid and releasably attached to said holddown such that when said holddown is attached to said main lid part and said pull tab is pulled away from said main lid part, the pull tab is detached from the holddown while said holddown remains attached to said main lid part.

8. The container of claim 7 wherein when in said stowed position, said holddown is attached to said main lid part and said pull tab is attached to said holddown, further comprising a redeployed position in which said holddown is attached to said main lid part and said pull tab is detached from said holddown;

wherein when in said redeployed position, said pull tab is prevented from being reattached to said holddown.

9. The container of claim 8 wherein said lid is not disengageable from said base when said pull tab assembly is in said stowed position and is disengageable from said base when said pull tab assembly is in said redeployed position.

10. The container of claim 9 wherein when said pull tab assembly is in said deployed position, said holddown is further detached from said main lid part and said pull tab is attached to said holddown.

11. The container of claim 7 wherein said pull tab assembly is configured such that when said pull tab is detached from said holddown, said pull tab is prevented from lying against said main lid part.

12. The container of claim 7 wherein said pull tab assembly further includes a hinge for pivotally attaching said pull tab to said lid;

said hinge being configured to cause said pull tab to spring up from said main lid part when said pull tab is detached from said holddown.

13. The container of claim 7 wherein said spring wall of said pull tab assembly is further configured to cause said pull tab to spring away from said main lid part to remain in said raised position when said pull tab is detached from said holddown.

14. The container of claim 7 wherein said breakable joint is disposed between said pull tab and said holddown for releasably attaching said pull tab to said hold down.

15. The container of claim 14 wherein said breakable joint includes a bridge connecting said pull tab to said holddown such that when said pull tab is pulled away from said main lid part, said bridge breaks.

16. The container of claim 7 wherein said holddown is mechanically attached to said main lid part.

17. The container of claim 16 wherein said pull tab assembly includes a lock projection disposed on said holddown and a lock recess disposed on said main-lid part for receiving said lock projection.

18. The container of claim 7 wherein said holddown is attached to said main lid part by bonding.

19. The container of claim 18 wherein said holddown is adhered to said main lid part.

20. The container of claim 18 wherein said holddown is welded to said main lid part.

* * * * *